US012352010B2

(12) United States Patent
Kabata et al.

(10) Patent No.: US 12,352,010 B2
(45) Date of Patent: Jul. 8, 2025

(54) CONTROL METHOD OF WORK MACHINE, PROGRAM, CONTROL SYSTEM, AND WORK MACHINE

(71) Applicant: Yanmar Holdings Co., Ltd., Osaka (JP)

(72) Inventors: Hiroki Kabata, Fukuoka (JP); Katsuya Miyazaki, Fukuoka (JP); Kazuki Takeda, Fukuoka (JP); Daisuke Kawaguchi, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 0 days.

(21) Appl. No.: 18/648,100

(22) Filed: Apr. 26, 2024

(65) Prior Publication Data

US 2024/0360649 A1 Oct. 31, 2024

(30) Foreign Application Priority Data

Apr. 28, 2023 (JP) ..... 2023-074705

(51) Int. Cl.

| | |
|---|---|
| ***E02F 9/20*** | (2006.01) |
| ***E02F 9/08*** | (2006.01) |
| ***E02F 9/22*** | (2006.01) |
| ***F01N 9/00*** | (2006.01) |

(52) U.S. Cl.

CPC ..... *E02F 9/2095* (2013.01); *E02F 9/0866* (2013.01); *E02F 9/2066* (2013.01); *E02F 9/2235* (2013.01); *E02F 9/226* (2013.01); *F01N 9/002* (2013.01); *E02F 9/2285* (2013.01); *E02F 9/2296* (2013.01)

(58) Field of Classification Search

CPC ..... E02F 9/226; E02F 9/24

See application file for complete search history.

(56) References Cited

U.S. PATENT DOCUMENTS

| | | | | |
|---|---|---|---|---|
| 8,459,008 | B2 * | 6/2013 | Kamiya | E02F 9/2228 60/285 |
| 8,601,799 | B2 * | 12/2013 | Asakage | E02F 9/2282 60/303 |
| 8,869,928 | B2 * | 10/2014 | Yoshida | E02F 9/2285 60/285 |
| 9,032,718 | B2 * | 5/2015 | Noma | E02F 9/2066 60/297 |
| 9,080,311 | B2 * | 7/2015 | Yoshida | E02F 9/2285 |
| 9,915,056 | B2 * | 3/2018 | Tanaka | F15B 1/00 |

* cited by examiner

*Primary Examiner* — Michael Leslie
(74) *Attorney, Agent, or Firm* — Chris Mizumoto

(57) ABSTRACT

A control method of a work machine in which a rotation number of a fan that takes outside air into an engine room accommodating an engine varies with a rotation number of the engine, includes: executing first control of regenerating a collecting filter unit that collects particulates contained in exhaust gas of the engine by a temperature rise of the exhaust gas; when the work machine is changed from a steady state to a specific state, executing second control of decreasing an amount of working oil discharged from a hydraulic pump by driving of the engine; and, when the first control and the second control are concurrently executed, executing third control of increasing the rotation number of the engine.

10 Claims, 5 Drawing Sheets

CONTROL METHOD OF WORK MACHINE, PROGRAM, CONTROL SYSTEM, AND WORK MACHINE

CROSS-REFERENCE

This application claims foreign priority of JP2023-074705 filed Apr. 28, 2023, the disclosure of which is hereby incorporated by reference in its entirety.

TECHNICAL FIELD

The present invention relates to a control method of a work machine, a program, a control system, and a work machine.

This application claims foreign priority of JP2023-074705 filed Apr. 28, 2023, the disclosure of which is hereby incorporated by reference in its entirety.

BACKGROUND ART

In harsh work environment such as extreme heat, exposure to high temperature for a long time may cause negative effects on equipment mounted on a work machine. On the other hand, for example, Patent Document 1 discloses a work machine that suppresses a temperature rise of working oil to be supplied to a hydraulic actuator. The work machine reduces the amount of the working oil supplied by decreasing an inclination angle of a hydraulic pump in response to the temperature rise of the working oil. Moreover, the work machine alleviates deceleration control of the hydraulic actuator to reduce flow resistance of the working oil, thereby suppressing heat generation of the working oil. Accordingly, hydraulic equipment including the hydraulic actuator is prevented from being damaged.

PRIOR ART DOCUMENT

Patent Document

Patent Document 1: JP 2010-112075 A

SUMMARY OF INVENTION

Technical Problem

In recent years, there have been work machines each including a particulate collecting filter that collects particulates contained in exhaust gas discharged from an engine so as to purify the exhaust gas. The dust collecting filter is regenerated by burning the collected particulates by a periodic temperature rise of the exhaust gas. When the dust collecting filter is regenerated during work such as excavation, a temperature rise inside an engine room may cause negative effects on electric equipment mounted inside the work machine. However, Patent Document 1 does not recite prevention of the temperature rise caused by the regeneration of the dust collecting filter during work and the negative effects on the electric equipment due to the temperature rise.

In view of the above-described circumstances, it is an object of the present invention to suppress an excessive temperature rise inside an engine room.

Solution to Problem

In order to achieve the above-described object, in a control method of a work machine according to one mode of the present invention, a rotation number of a fan that takes outside air into an engine room accommodating an engine varies with a rotation number of the engine. The control method includes: executing first control of regenerating a collecting filter unit that collects particulates contained in exhaust gas of the engine by a temperature rise of the exhaust gas; when the work machine is changed from a steady state to a specific state, executing second control of decreasing an amount of working oil discharged from a hydraulic pump by driving of the engine; and, when the first control and the second control are concurrently executed, executing third control of increasing the rotation number of the engine.

Moreover, in order to achieve the above-described object, a program according to one mode of the present invention causes a computer to execute a control method of a work machine in which a rotation number of a fan that takes outside air into an engine room accommodating an engine varies with a rotation number of the engine. The program causes the computer to function as a means for: executing first control of regenerating a collecting filter unit that collects particulates contained in exhaust gas of the engine by a temperature rise of the exhaust gas; when the work machine is changed from a steady state to a specific state, executing second control of decreasing an amount of working oil discharged from a hydraulic pump by driving of the engine; and, when the first control and the second control are concurrently executed, executing third control of increasing the rotation number of the engine.

Moreover, in order to achieve the above-described object, a control system of a work machine according to one mode of the present invention includes: an engine; a fan; a collecting filter unit; a hydraulic pump; and a control unit. The engine is accommodated in an engine room. A rotation number of the fan varies with a rotation number of the engine, and the fan takes outside air into the engine room. The collecting filter unit collects particulates contained in exhaust gas of the engine. The hydraulic pump discharges working oil by driving of the engine. The control unit controls the engine and a regulator. The control unit executes first control of regenerating the collecting filter unit by a temperature rise of the exhaust gas, when the work machine is changed from a steady state to a specific state, executes second control of decreasing an amount of the working oil discharged, and, when the first control and the second control are concurrently executed, executes third control of increasing the rotation number of the engine.

Moreover, in order to achieve the above-described object, a work machine according to one mode of the present invention is configured to include the above-described control system.

Additional features and advantages of the present invention will become more apparent from the following embodiment.

Advantageous Effects of Invention

According to the present invention, an excessive temperature rise inside an engine room can be suppressed.

DESCRIPTION OF EMBODIMENTS

Hereinafter, an embodiment of the present invention will be described with reference to the drawings.

1. Hydraulic Excavator 1

Figure 1:
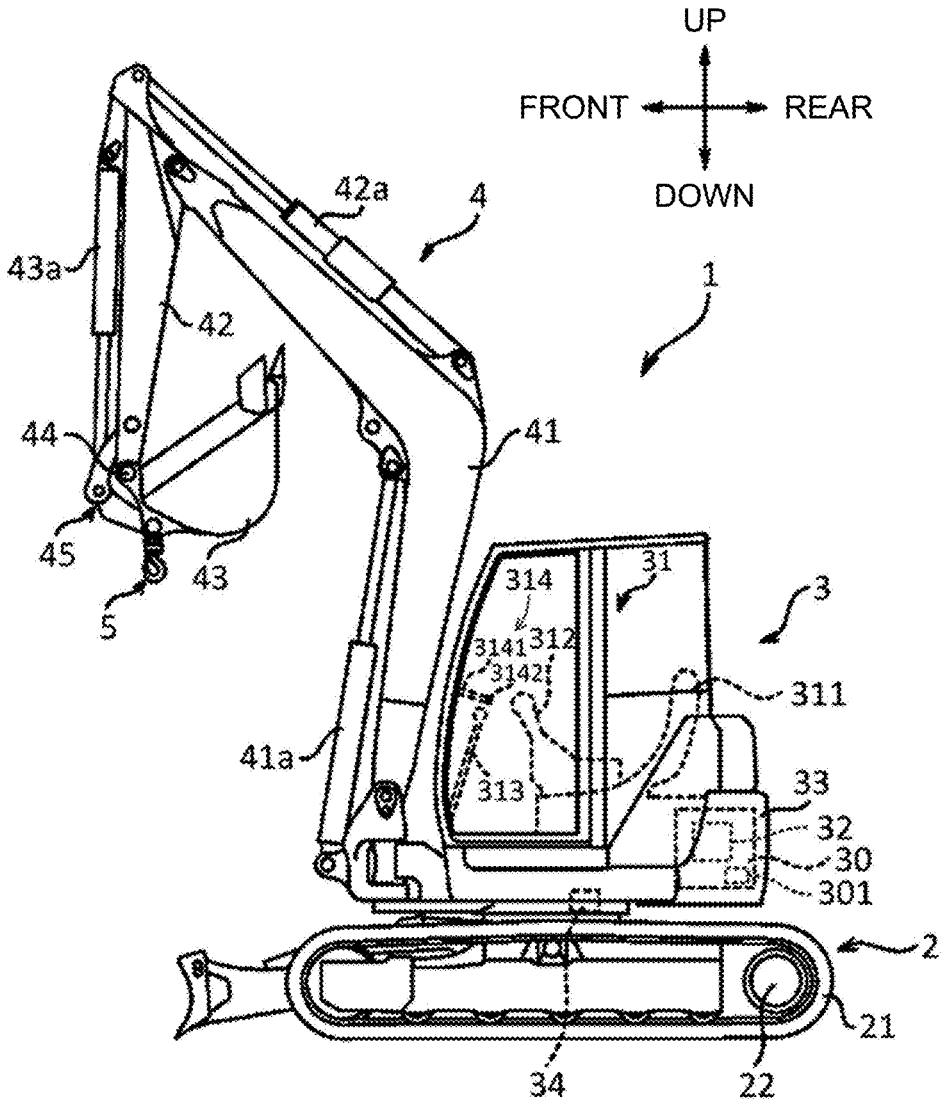
FIG. 1 is a left side view illustrating a hydraulic excavator according to a present embodiment.

First, a schematic structure of a hydraulic excavator 1 as an example of a work machine will be described with reference to FIG. 1. The hydraulic excavator 1 includes a lower traveling body 2 capable of causing the hydraulic excavator 1 to travel, an upper slewing body 3 mounted on an upper part of the lower traveling body 2 so as to be slewable, a work implement 4 mounted on the upper slewing body 3 swingably in an up-down direction, and a hoisting attachment 5 attached to a distal end of the work implement 4 swingably in a front-rear direction.

<1-1. Lower Traveling Body 2>

The lower traveling body 2 is driven by power from an engine 32 to cause the hydraulic excavator 1 to travel. The lower traveling body 2 includes a pair of right and left crawlers 21, 21 and a pair of right and left traveling motors 22, 22. The right crawler 21 and the right traveling motor 22 are not illustrated in FIG. 1. The right and left traveling motors 22, 22, which are hydraulic motors, drive the right and left crawlers 21, 21, respectively, thereby enabling the hydraulic excavator 1 to move forward and backward.

<1-2. Upper Slewing Body 3>

The upper slewing body 3 is configured to be slewable relative to the lower traveling body 2 via a slewing bearing (not illustrated). In the upper slewing body 3, an operation unit 31, the engine 32, a slewing base 33, a slewing motor 34, and the like are arranged. The upper slewing body 3 slews by driving force of the slewing motor 34, which is a hydraulic motor, via the slewing bearing. Moreover, a plurality of hydraulic pumps to be driven by the engine 32 are arranged in the upper slewing body 3. The hydraulic pumps supply working oil to the traveling motors 22, 22, the slewing motor 34, and a boom cylinder 41*a*, an arm cylinder 42*a*, and a bucket cylinder 43*a*, which will be described below, and the like. The traveling motor 22 can switch a rotation number per unit time in response to the amount of the working oil supplied. Hereinafter, the rotation number per unit time will be simply referred to as the "rotation number" without limiting to the traveling motor 22.

An operation seat 311 is arranged in the operation unit 31. A pair of work operation levers 312, 312 is arranged on the right and left of the operation seat 311. A pair of traveling levers 313, 313 is arranged in front of the operation seat 311. An operator sits on the operation seat 311 and operates the work operation levers 312, 312, the traveling levers 313, 313, and the like to control the engine 32, hydraulic motors, hydraulic actuators, and the like, so that traveling, slewing, work, and the like can be performed.

Moreover, an operation panel 314 is arranged in front of the operation seat 311. The operation panel 314 has a display unit 3141 and an operation button including an engine accelerator dial 3142. However, the present embodiment is not limited to this example, and the engine accelerator dial 3142 may be arranged on the right or left of the operation seat 311. The display unit 3141 displays an image for notifying the operator of the state of the hydraulic excavator 1 and the like. The engine accelerator dial 3142 is a rotation number setting unit for the operator to set a target rotation number per unit time of the engine 32. Hereinafter, the target rotation number per unit time will be simply referred to as the "target rotation number".

The engine 32 is accommodated in an engine room 30. A fan 321 (refer to FIG. 2) is attached to the engine 32. That is, the hydraulic excavator 1 has the fan 321. The fan 321 rotates with driving of the engine 32, and takes outside air into the engine room 30 accommodating the engine 32. The rotation number of the fan 321 varies with the rotation number of the engine 32. That is, when the rotation number of the engine 32 increases, the rotation number of the fan 321 increases. In contrast, when the rotation number of the engine 32 decreases, the rotation number of the fan 321 decreases.

<1-3. Work Implement 4>

The work implement 4 is driven by power from the engine 32 to perform excavation work of soil and the like. The work implement 4 includes a boom 41, an arm 42, and a bucket 43, and can perform the excavation work by independently driving the boom 41, the arm 42, and the bucket 43.

A proximal end part of the boom 41 is supported by a front part of the upper slewing body 3, and the boom 41 is swung in the up-down direction by the boom cylinder 41*a* which can extendably move.

A proximal end part of the arm 42 is supported by a distal end part of the boom 41, and the arm 42 is swung in the up-down direction by the arm cylinder 42*a* which can extendably move.

A proximal end part of the bucket 43 is supported by a distal end part of the arm 42, and the bucket 43 is swung in the front-rear direction by the bucket cylinder 43*a* which can extendably move.

The boom cylinder 41*a*, the arm cylinder 42*a*, and the bucket cylinder 43*a* correspond to hydraulic actuators that drive the work implement 4.

The bucket 43 is a container-shaped member that is attached to the distal end of the work implement 4 and includes claws for performing the excavation work. The bucket 43 is swingably attached via a pin 44 attached to the distal end of the arm 42. Furthermore, the bucket 43 is connected to the bucket cylinder 43*a* via a link mechanism 45.

<1-4. Control System 6>

Figure 2:
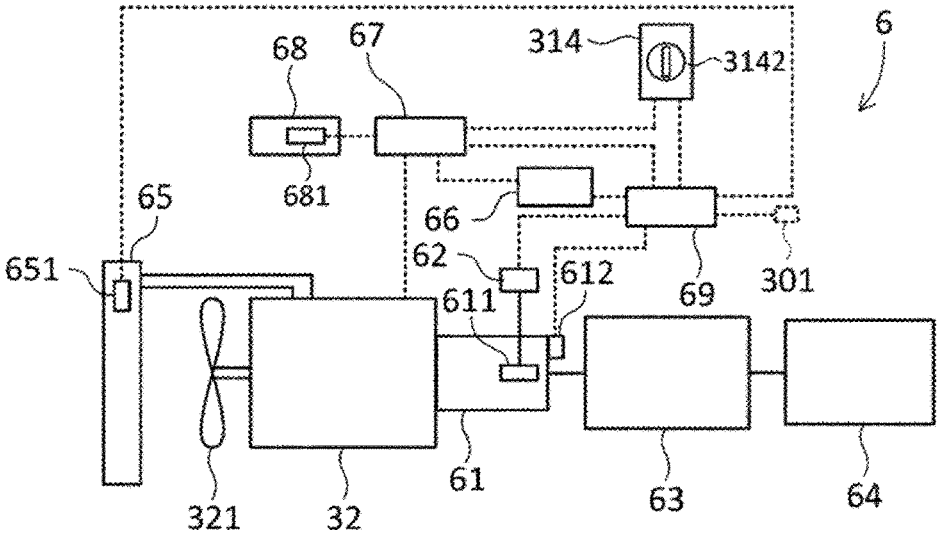
FIG. 2 is a schematic view illustrating an example of a control system according to the present embodiment.

Next, a control system 6 included in the hydraulic excavator 1 will be described with reference to FIG. 2. FIG. 2 is a schematic view illustrating an example of the control system 6 according to the present embodiment. In the present embodiment, the control system 6 includes a variable capacity pump 61, a pump regulator 611, a solenoid 62, a control valve 63, a hydraulic actuator 64, a radiator 65, a storage unit 66, an engine ECU 67, a diesel particulate filter (DPF) 68, and an integrated ECU 69.

The variable capacity pump 61 is a hydraulic pump that discharges the working oil by the driving of the engine 32, and supplies the working oil to the hydraulic actuator 64. The hydraulic actuator 64 includes the boom cylinder 41*a*, the arm cylinder 42*a*, the bucket cylinder 43*a*, the traveling motor 22, the slewing motor 34, and the like.

An inclination angle of the variable capacity pump 61 is changed by the pump regulator 611 to be driven by the solenoid 62. The pump regulator 611 changes the amount of the working oil discharged in the variable capacity pump 61.

Moreover, a temperature sensor 612 is arranged in the variable capacity pump 61. The temperature sensor 612 detects a temperature of the working oil discharged from the variable capacity pump 61, and transmits the detection result to the integrated ECU 69.

The control valve 63 is arranged between the variable capacity pump 61 and the hydraulic actuator 64, and controls a flow of the working oil to be supplied from the variable capacity pump 61 to the hydraulic actuator 64. The control valve 63 includes a plurality of direction switching valves (not illustrated). The direction switching valves are pilot direction switching valves capable of switching the direction and capacity of the working oil to be pressure-fed from the variable capacity pump 61. For example, the direction switching valves can be switched to a plurality of positions, and are switched, on the basis of a received switching signal, from a neutral position to a position indicated by the switching signal. The respective positions are connected to components included in the hydraulic actuator 64 (that is, the boom cylinder 41*a*, the arm cylinder 42*a*, the bucket cylinder 43*a*, the traveling motor 22, the slewing motor 34, and the like). The working oil is supplied to the components of the hydraulic actuator 64, which are connected to the switched positions.

The radiator 65 cools cooling water of the engine 32. A temperature sensor 651 is arranged in the radiator 65. The temperature sensor 651 detects a temperature of the cooling water sent from the engine 32 to the radiator 65, and transmits the detection result to the integrated ECU 69.

The storage unit 66 is a non-transitory storage medium that retains memory even when electric power supply is stopped. The storage unit 66 stores information, programs, and the like used in the engine ECU 67, the integrated ECU 69, and the like.

The engine ECU 67 can communicate with the integrated ECU 69, receives operation input of the operation unit 31, an instruction signal of the integrated ECU 69, a detection result of a differential pressure sensor 681 of the DPF 68, and the like, and instructs driving of the engine 32, regeneration of the DPF 68, and the like. In the present embodiment, the engine ECU 67 is a control unit different from the integrated ECU 69. However, the present embodiment is not limited to this example, and the engine ECU 67 may be the same control unit as the integrated ECU 69.

The DPF 68 is a collecting filter unit that collects particulates and the like contained in exhaust gas of the engine 32. For example, the DPF 68 has an oxidation catalytic filter member and a collecting filter member, and discharges the exhaust gas through the oxidation catalytic filter member and the collecting filter member. The oxidation catalytic filter member decomposes harmful components in the exhaust gas to produce, for example, $NO_2$ from NOx. Moreover, $H_2O$, $CO_2$ and the like are produced from HC and CO in the exhaust gas. The collecting filter member collects particulates such as particulate matter (PM) contained in the exhaust gas. The collected particulates are removed by, for example, executing the regeneration of the DPF 68 at a predetermined timing. In this regeneration processing, a temperature of the exhaust gas is increased by an after-injection of the engine 32 or the like, so that the particulates are burned by $NO_2$ produced by the oxidation catalytic filter member and oxygen in the exhaust gas. Accordingly, clogging of the collecting filter member is prevented.

The differential pressure sensor 681 is arranged in the DPF 68. The differential pressure sensor 681 detects a pressure difference ΔP between an inlet and an outlet of the collecting filter member, and transmits the detection result to the engine ECU 67. For example, when the pressure difference ΔP detected by the differential pressure sensor 681 is equal to or more than a threshold value APs, the engine ECU 67 executes the regeneration of the DPF 68.

<1-4-1. Integrated ECU 69>

The integrated ECU 69 is a control unit that controls respective units configuring the control system 6. The integrated ECU 69 directly or indirectly receives the operation input of the operation unit 31 and the detection results of the temperature sensors 301, 612, and 651, and controls the respective units configuring the control system 6 independently or together with the engine ECU 67. For example, the integrated ECU 69 transmits an instruction to the engine ECU 67 on the basis of a setting of the engine accelerator dial 3142 to control the engine 32, so that the rotation number of the engine 32 approaches the target rotation number. Moreover, the integrated ECU 69 controls the amount of the working oil discharged in the variable capacity pump 61 by control of the solenoid 62. Accordingly, a discharge pressure of the working oil is changed, that is, output of the variable capacity pump 61 is changed.

Figure 3:
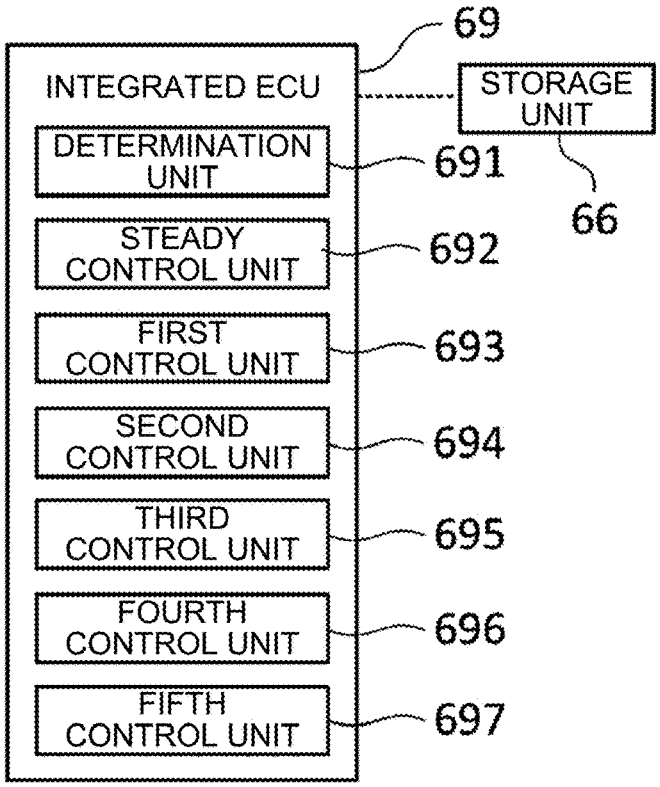
FIG. 3 is a functional block diagram illustrating a configuration example of an integrated ECU.

FIG. 3 is a functional block diagram illustrating a configuration example of the integrated ECU 69. The integrated ECU 69 has a determination unit 691, a steady control unit 692, a first control unit 693, a second control unit 694, a third control unit 695, a fourth control unit 696, and a fifth control unit 697. A computer such as a processor included in the integrated ECU 69 executes arithmetic processing in accordance with a program, so that functions of the respective units 691 to 697 are achieved.

The determination unit 691 determines whether detection temperatures of the temperature sensors 301, 612, and 651 are equal to or more than respective temperature threshold values.

In the hydraulic excavator 1 in a steady state, the steady control unit 692 drives the engine 32 at a rotation number set by the engine accelerator dial 3142 with a rated rotation number Nr of the engine 32 as an upper limit of the actual rotation number. In the present embodiment, the steady state is a state in which a detection temperature T of the temperature sensor 651 for the cooling water is less than a temperature threshold value Ts. However, the present embodiment is not limited to this example, and the steady state may be a state in which at least one of the detection temperatures of the temperature sensor 301 in the engine room 30, the temperature sensor 612 for the working oil, and the temperature sensor 651 for the cooling water of the engine 32 is less than each temperature threshold value.

The first control unit 693 executes first control. The first control regenerates the DPF 68 by a temperature rise of the exhaust gas of the engine 32. For example, when the pressure difference ΔP detected by the differential pressure sensor 681 exceeds the threshold value APs, the first control unit 693 executes the above-described first control (i.e., the regeneration processing of the DPF 68). The first control is executed in a state in which the hydraulic excavator 1 can perform work. Thus, the regeneration processing of the DPF 68 can be performed while the work by the hydraulic excavator 1 is continued.

The second control unit 694 executes second control. When the hydraulic excavator 1 is changed from the steady state to a specific state, the second control decreases the amount of the working oil discharged from the variable capacity pump 61 by the driving of the engine 32. That is, in the second control, the amount of the working oil discharged with respect to the rotation number N of the engine 32 in the specific state is set to be lower than the amount of the working oil discharged with respect to the rotation number N of the engine 32 in the steady state.

The specific state includes a state in which the temperature in the engine room 30 is equal to or more than a temperature threshold value higher than the temperature in the steady state. For example, in the present embodiment, the specific state is a state in which the detection temperature T of the temperature sensor 651 for the cooling water is equal to or more than the temperature threshold value Ts. However, the present embodiment is not limited to this example, and the specific state may be a state in which the detection temperature of the temperature sensor 301 in the engine room 30 is equal to or more than the temperature threshold value, or a state in which the detection temperature of the temperature sensor 612 for the working oil of the variable capacity pump 61 is equal to or more than the temperature threshold value. That is, the specific state may be a state in which at least one of the detection temperatures of the temperature sensor 301 in the engine room 30, the temperature sensor 612 for the working oil, and the temperature sensor 651 for the cooling water of the engine 32 is equal to or more than each temperature threshold value. A temperature rise in the engine room 30 can be detected by the detection temperature of any of the temperature sensors 301, 612, and 651. Thus, during the temperature rise in the engine room 30, output R of the variable capacity pump 61 is decreased to reduce load applied to the engine 32, so that a further temperature rise in the engine room 30 can be prevented.

Figure 4:
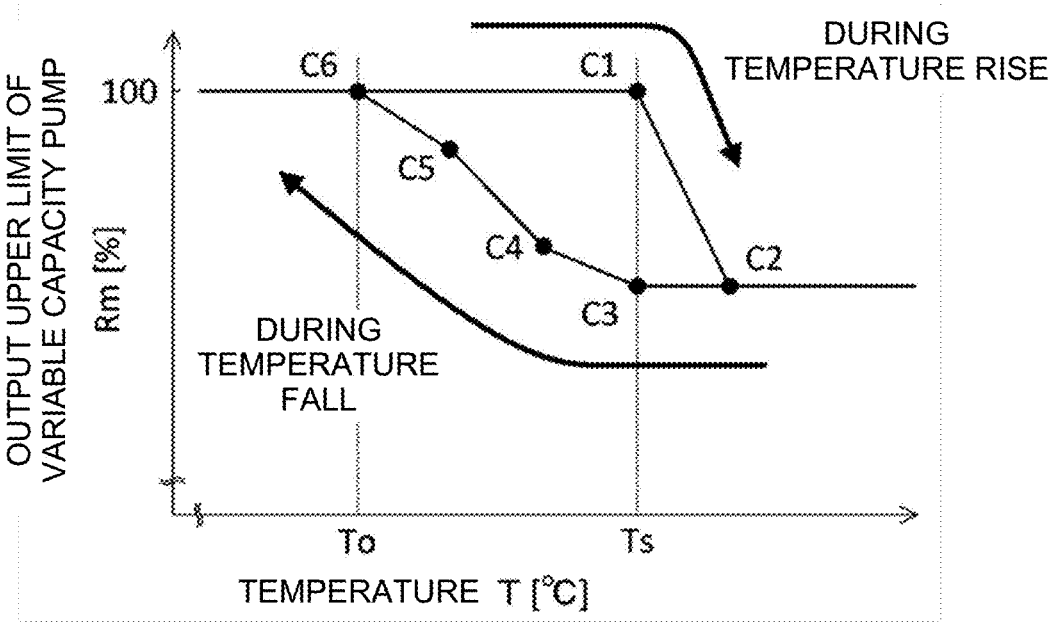
FIG. 4 is a graph illustrating a change in an output upper limit of a variable capacity pump in second control.

FIG. 4 is a graph illustrating a change in an output upper limit Rm of the variable capacity pump 61 in the second control. In FIG. 4, the target rotation number of the engine 32 is set to a set upper limit value (for example, the rated rotation number Nr). That is, FIG. 4 illustrates a change in the usable output upper limit Rm of the variable capacity pump 61 during a rise and fall of the detection temperature T.

As illustrated in FIG. 4, in a case in which the detection temperature T of the cooling water tends to rise, when the detection temperature Tis less than the temperature threshold value Ts, the output R of the variable capacity pump 61 can be used up to the maximum (that is, 100%). When the detection temperature T becomes equal to or more than the temperature threshold value Ts, in order to prevent a further temperature rise of the engine 32 and the inside of the engine room 30, the usable output upper limit Rm of the variable capacity pump 61 is sharply decreased. By decreasing the output upper limit Rm of the variable capacity pump 61 to reduce the load applied to the engine 32, a rise of the detection temperature T of the cooling water is prevented or a fall of the detection temperature T of the cooling water is promoted. Furthermore, by maintaining the rotation number N of the engine 32, the fan 321 is caused to rotate at a high speed to take in a larger amount of outside air, the engine 32 and the inside of the engine room 30 are cooled, and the detection temperature T can be decreased.

In contrast, in a case in which the detection temperature T of the cooling water tends to fall, the usable output upper limit of the variable capacity pump 61 is set to a predetermined value until the detection temperature T becomes less than the temperature threshold value Ts. When the detection temperature T becomes less than the temperature threshold value Ts, the usable output upper limit of the variable capacity pump 61 gradually rises up to the maximum (that is, 100%). Accordingly, since a working speed of the hydraulic excavator 1 gradually returns (that is, rises), a collision accident, a pinch accident, or the like in the hydraulic excavator 1 (particularly, the work implement 4) can be prevented.

Therefore, by performing control in the second control as illustrated in FIG. 4, the hydraulic excavator 1 can continue the work while achieving a heat balance of the engine 32 and the inside of the engine room 30 even under a high-temperature environment for a long time.

Figure 5:
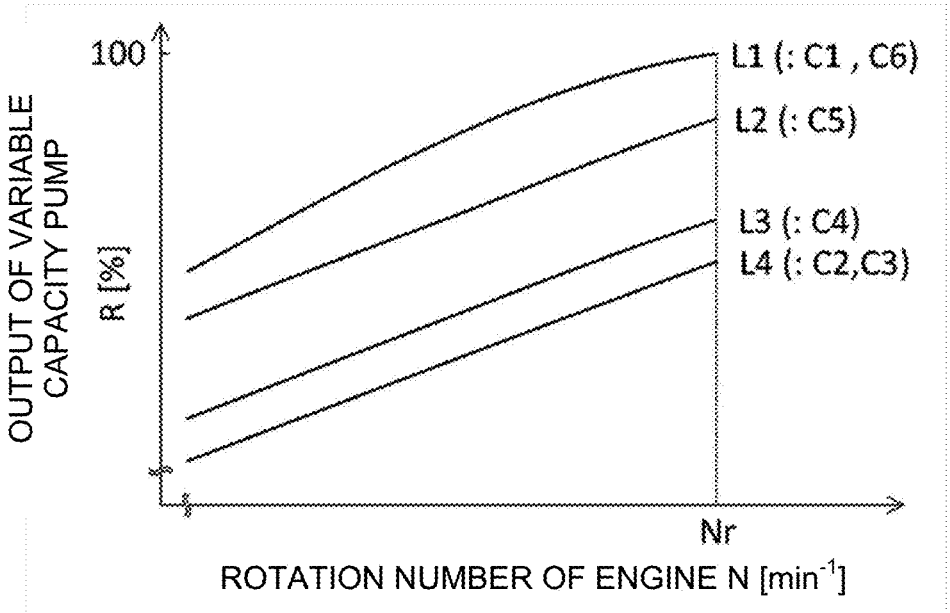
FIG. 5 is a graph illustrating a change in output of the variable capacity pump with respect to a rotation number of an engine at each temperature in the second control.

Moreover, FIG. 5 is a graph illustrating a change in the output R of the variable capacity pump 61 with respect to the rotation number N of the engine 32 at each detection temperature T in the second control. In FIG. 5, L1 indicates a change in the output R with respect to the rotation number N of the engine 32 in the states of the point C1 and the point C6 in FIG. 4. L2 indicates a change in the output R with respect to the rotation number N of the engine 32 in the state of the point C5 in FIG. 4. L3 indicates a change in the output R with respect to the rotation number N of the engine 32 in the state of the point C4 in FIG. 4. L4 indicates a change in the output R with respect to the rotation number N of the engine 32 in the states of the point C2 and the point C3 in FIG. 4.

As illustrated in FIG. 5, in the second control, the output R of the variable capacity pump 61 varies with the actual rotation number N of the engine 32. Accordingly, the hydraulic excavator 1 can obtain the output R of the variable capacity pump 61 corresponding to the rotation number N of the engine 32. Thus, the operability of the hydraulic excavator 1 can be favorably maintained.

However, the output R obtained at the same rotation number N varies depending on the detection temperature T of the cooling water (that is, the temperature of the engine 32 and the inside of the engine room 30) (refer to C1 to C6 in FIG. 4).

For example, in a case in which the detection temperature T of the cooling water tends to rise, when the detection temperature T is less than the temperature threshold value Ts, the output R with respect to the rotation number N changes like L1. When the detection temperature T becomes equal to or more than the temperature threshold value Ts, the output R with respect to the rotation number N is sharply decreased and changes like L4. That is, the output R of the variable capacity pump 61 is decreased. Accordingly, overheating of the hydraulic excavator 1 during a high-load operation and engine stall (unintended stop of the engine 32) caused by the overheating can be prevented.

In contrast, in a case in which the detection temperature T of the cooling water tends to fall, when the detection temperature T becomes less than the temperature threshold value Ts, the output R with respect to the rotation number N changes in a higher range in accordance with the decrease in the detection temperature T. That is, higher output R can be obtained for the same rotation number N. Accordingly, since the workability of the hydraulic excavator 1 is gradually recovered, the hydraulic excavator 1 can be used safely.

Therefore, by performing control in the second control as illustrated in FIG. 5, the operability of the hydraulic excavator 1 can be favorably maintained while capable of continuing high-load work for a long time.

Next, the third control unit 695 executes third control. When the first control by the first control unit 693 and the second control by the second control unit 694 are concurrently executed, the third control increases the rotation number N of the engine 32. When the first control is ended, the third control unit 695 stops the third control.

Figure 6:
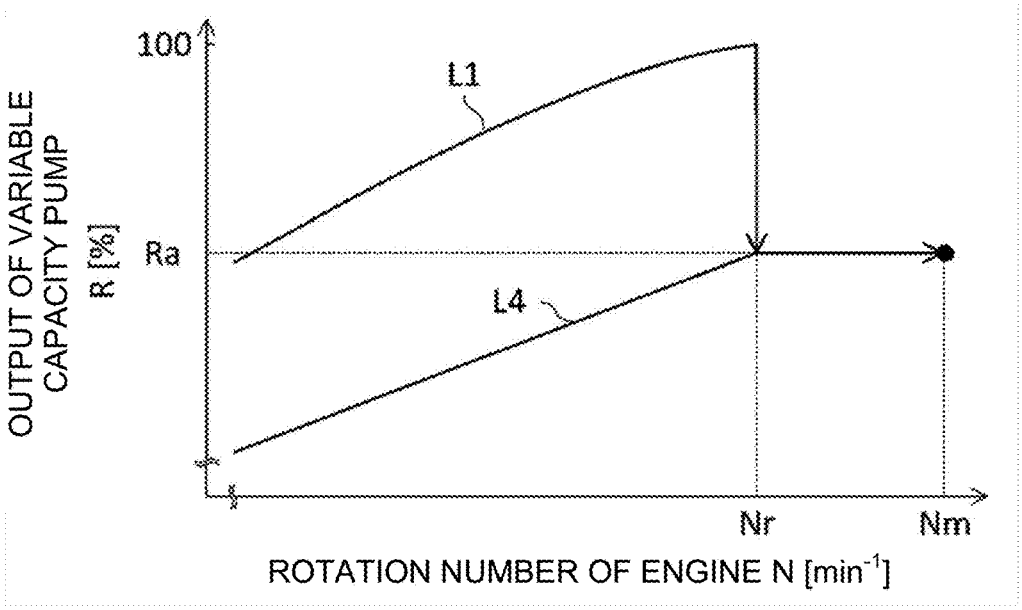
FIG. 6 is a graph illustrating a change in the rotation number of the engine and the output of the variable capacity pump in third control.

FIG. 6 is a graph illustrating a change in the rotation number N of the engine 32 and the output R of the variable capacity pump 61 in the third control. In FIG. 6, L1 indicates a change in the output R with respect to the rotation number N of the engine 32 in the states of the point C1 and the point C6 in FIG. 4. L4 indicates a change in the output R with respect to the rotation number N of the engine 32 in the states of the point C2 and the point C3 in FIG. 4.

When the regeneration processing of the DPF 68 is performed under the above-described specific state, the third control unit 695 decreases the output R of the variable capacity pump 61 and increases the rotation number N of the engine 32 up to a rotation number Nm exceeding the rated rotation number Nr. For example, as illustrated in FIG. 6, during work in a state in which the engine 32 is at the maximum rotation number (that is, the rated rotation number Nr), high load is applied to the engine 32, and the inside of the engine room 30 becomes a high-temperature environment. At this time, when the regeneration processing of the DPF 68 (that is, the first control) is started, the third control unit 695 decreases the output R of the variable capacity pump 61 to Ra. That is, the third control unit 695 suppresses or prevents the temperature rise of the engine 32 and the inside of the engine room 30 by reducing the load applied to the engine 32 due to the decrease in the output R.

Then, the third control unit 695 increases the rotation number N to the value Nm close to the maximum rotation number, at which the engine 32 can be driven, regardless of the target rotation number set by the engine accelerator dial 3142. At this time, since the load of the engine 32 is decreased due to the decrease in the output R, the engine 32 does not generate much heat. Moreover, by increasing the rotation number N of the engine 32 to exceed the rated rotation number Nr, the rotation number of the fan 321 is increased to take a larger amount of outside air into the engine room 30, and the engine 32 and the inside of the engine room 30 can be cooled. That is, the cooling capacity of the engine 32 and the inside of the engine room 30 by the fan 321 is improved.

Therefore, even in the regeneration processing of the DPF 68 in which the inside of the engine room 30 becomes a severer high-temperature environment, a heat balance between the temperature rise of the engine 32 and the inside of the engine room 30 and the temperature fall due to the cooling by the fan 321 can be achieved, and the work of the hydraulic excavator 1 can be continued. Moreover, in the third control, the temperature in the engine room 30 of the hydraulic excavator 1 is not excessively increased, and thus, the equipment arranged in the engine room 30 can be sufficiently protected from heat.

Next, the fourth control unit 696 executes fourth control. In the fourth control, when the target rotation number of the engine 32 is set to be small by the engine accelerator dial 3142 in the third control, the amount of the working oil discharged in the variable capacity pump 61 is further decreased while the rotation number of the engine 32 is kept increased. Thus, an operation speed of the hydraulic actuator 64 can be reduced in accordance with the setting of the engine accelerator dial 3142 due to the decrease in the amount of the working oil discharged (that is, the output R) in the variable capacity pump 61 even while the rotation number of the engine 32 is kept increased. Therefore, the working speed of the hydraulic excavator 1 can be freely changed by the operator's intention.

Moreover, even during the third control, the rotation number N of the engine 32 remains high by the use of the engine accelerator dial 3142, but the operation speed of the hydraulic actuator 64 can be changed by decreasing the amount of the working oil discharged in the variable capacity pump 61. Thus, as in the case of the steady state, the operator can control the operation of the hydraulic actuator 64 by the use of the engine accelerator dial 3142. Therefore, the operability of the operator can be prevented from being impaired.

Figure 7:
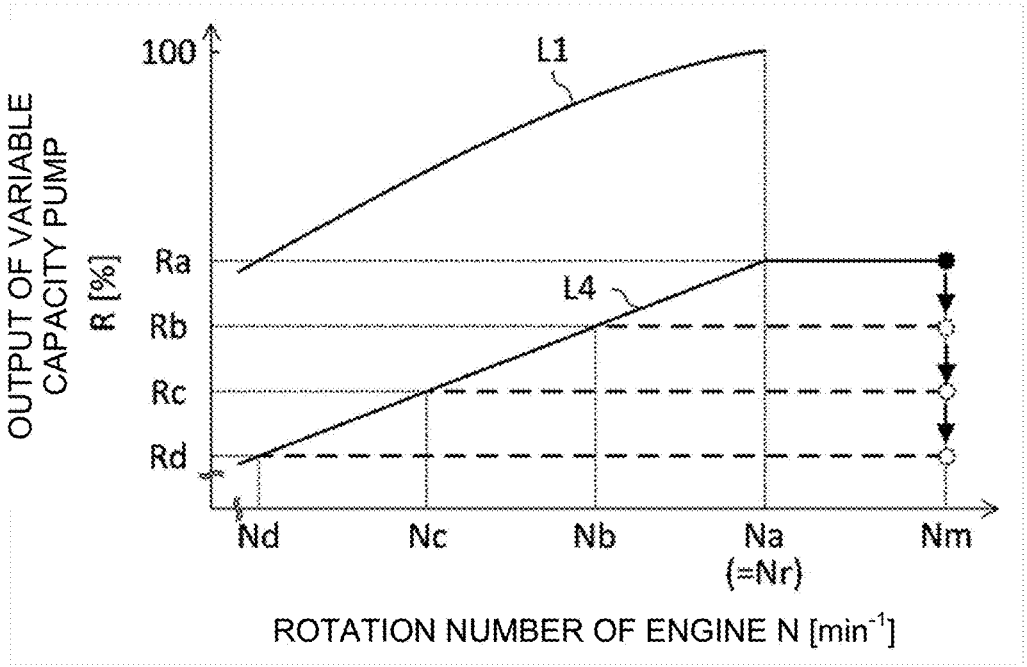
FIG. 7 is a graph illustrating a change in the rotation number of the engine and the output of the variable capacity pump in fourth control.

FIG. 7 is a graph illustrating a change in the rotation number N of the engine 32 and the output R of the variable capacity pump 61 in the fourth control. In FIG. 7, L1 indicates a change in the output R with respect to the rotation number N of the engine 32 in the states of the point C1 and the point C6 in FIG. 4. L4 indicates a change in the output R with respect to the rotation number N of the engine 32 in the states of the point C2 and the point C3 in FIG. 4.

As illustrated in FIG. 7, in the fourth control, preferably, the amount of the working oil discharged in the variable capacity pump 61 is decreased to an amount corresponding to the target rotation number set by the engine accelerator dial 3142 in the second control. For example, in the third control, when the target rotation number in the engine accelerator dial 3142 is set to a value Na (that is, the rated rotation number Nr), the output R of the variable capacity pump 61 is decreased from 100 [%] to Ra [%]. As illustrated in FIG. 7, when the target rotation number in the engine accelerator dial 3142 is set to be as small as a value Nb, the output R of the variable capacity pump 61 is decreased to Rb [%] while the engine 32 maintains the rotation number Nm. Moreover, when the target rotation number in the engine accelerator dial 3142 is set to be as small as a value Nc, the output R of the variable capacity pump 61 is decreased to Rc [%] while the engine 32 maintains the rotation number Nm. Thus, the output R of the variable capacity pump 61 can be prevented from being excessively decreased. Therefore, since the operation speed of the hydraulic actuator 64 does not become too slow, the workability of the hydraulic excavator 1 can be maintained.

Next, the fifth control unit 697 executes fifth control. In the fifth control, when the target rotation number set by the engine accelerator dial 3142 is set to be lower than a threshold rotation number, the fourth control is stopped, and the engine 32 is controlled on the basis of the target rotation number. For example, when the target rotation number is set to be lower than the threshold rotation number, the rotation number of the engine 32 is controlled by a relationship of the output R with respect to the rotation number N in accordance with the detection temperature of the temperature sensor 651 (refer to L2, L3, and L4 in FIG. 5). The threshold rotation number is a sufficiently low value to the extent that the temperature decrease in the engine room 30 can be achieved, and is, for example, equal to or less than a rotation number Nd in FIG. 7. Thus, the engine 32 can be driven at an appropriate rotation number at which the engine 32 is not excessively heated. Therefore, an excessive temperature rise inside the engine room can be suppressed, and deterioration in the fuel efficiency of the engine 32 can be prevented.

2. Control Method of Hydraulic Excavator 1

Figure 8:
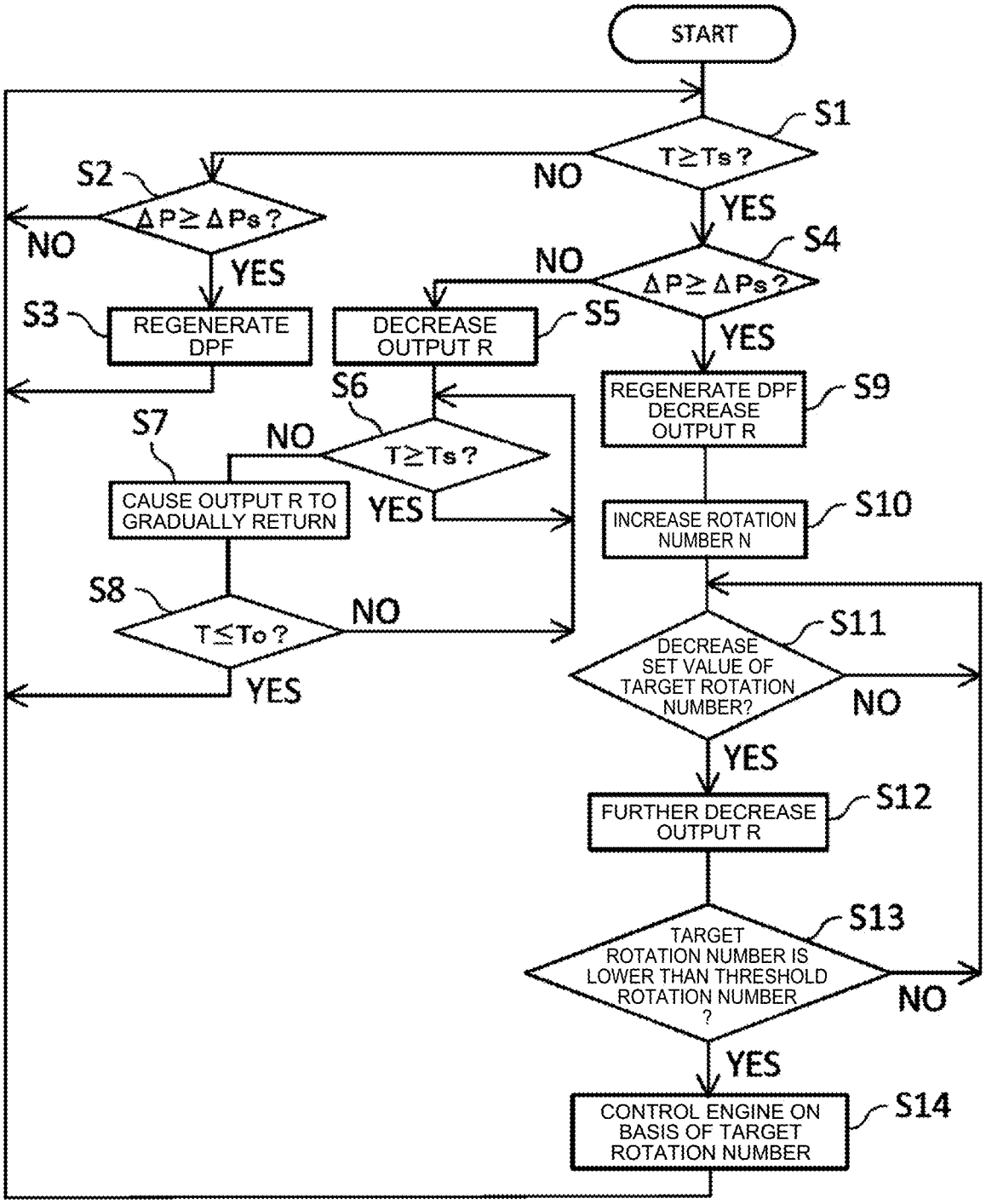
FIG. 8 is a flowchart for explaining an example of a control method of the hydraulic excavator.

Next, an example of a control method of the hydraulic excavator 1 in which the rotation number of the fan 321 that takes outside air into the engine room 30 accommodating the engine 32 varies with the rotation number of the engine 32 will be described. FIG. 8 is a flowchart for explaining the example of the control method of the hydraulic excavator 1. A computer mounted on the integrated ECU 69 executes arithmetic processing in accordance with a program, so that the control method illustrated in FIG. 8 is achieved. Moreover, the program is stored in the storage unit 66, and causes the computer mounted on the integrated ECU 69 to function as a means for performing the control method illustrated in FIG. 8. For example, the program is started when the hydraulic excavator 1 is activated, and is ended when the activation of the hydraulic excavator 1 is stopped.

First, whether the detection temperature T of the temperature sensor 651 is equal to or more than the temperature threshold value Ts is determined (step S1). When T is less than Ts (NO in step S1), whether the pressure difference ΔP detected by the differential pressure sensor 681 is equal to or more than the threshold value APs is determined (step S2). When the pressure difference ΔP is less than the threshold value APs (NO in step S2), the processing returns to step S1. When the pressure difference ΔP is equal to or more than the threshold value APs (YES in step S2), the regeneration processing of the DPF 68 is executed by the first control (step S3), and the processing returns to step S1.

Moreover, when T is equal to or more than Ts (YES in step S1), the inside of the engine room 30 is determined to be changed from the steady state to the specific state. Then, whether the pressure difference ΔP detected by the differential pressure sensor 681 is equal to or more than the threshold value APs is determined (step S4).

When the pressure difference ΔP is less than the threshold value APs (NO in step S4), the amount of the working oil discharged (that is, the output R) in the variable capacity pump 61 is decreased by the second control (step S5). Then, whether the detection temperature T of the temperature sensor 651 is equal to or more than the temperature threshold value Ts is determined (step S6). When T is less than Ts (NO in step S6), the amount of the working oil discharged (that is, the output R) in the variable capacity pump 61 gradually returns in accordance with the detection temperature T (refer to FIG. 4 and FIG. 5) (step S7), and whether the detection temperature T of the temperature sensor 651 is equal to or less than a steady temperature To (refer to FIG. 4) is determined (step S8). When T is more than To (NO in step S8), the processing returns to step S6. When T is equal to or less than To (YES in step S8), the amount of the working oil discharged (that is, the output R) in the variable capacity pump 61 is returned to the amount in the steady state (refer to FIG. 4) to end the second control, and the processing returns to step S1. When the pressure difference ΔP detected by the differential pressure sensor 681 is equal to or more than the threshold value APs between step S6 and step S8, the first control is executed, and the processing proceeds to step S10 described below.

Next, when the pressure difference ΔP is equal to or more than the threshold value APs (YES in step S4), the regeneration processing of the DPF 68 by the first control and the decrease in the amount of the working oil discharged (that is, the output R) in the variable capacity pump 61 in the specific state by the second control are concurrently executed (step S9), and the rotation number N of the engine 32 is increased to equal to or more than the rated rotation number Nr (refer to FIG. 6) by the third control (step S10). Then, whether the target rotation number of the engine 32 is set to be small by the engine accelerator dial 3142 is determined (step S11).

When the target rotation number is set to be small (YES in step S11), the amount of the working oil discharged (that is, the output R) is further decreased while the rotation number N of the engine 32 is kept increased by the fourth control (step S12). Then, whether the set target rotation number is lower than the threshold rotation number is determined (step S13). When the set target rotation number is not lower than the threshold rotation number (NO is step S13), the processing returns to step S11.

When the set target rotation number is lower than the threshold rotation number (YES is step S13), the fourth control is stopped, and the engine 32 is controlled on the basis of the target rotation number by the fifth control (step S14). That is, the engine 32 is driven and controlled such that the rotation number N thereof becomes the target rotation number. Then, the processing returns to step S1.

In steps S11 to S13, when either the ending of the first control (that is, the ending of the regeneration processing of the DPF 68) or the ending of the second control (for example, a change from the specific state to the steady state) occurs, the third control, the fourth control, and the fifth control are immediately stopped, and the processing returns to step S1.

3. Remarks

The embodiment of the present invention has been described above. It should be understood by those skilled in the art that the above-described embodiment is merely an example, and various modifications can be made to the combination of the respective components and the respective pieces of processing, which are within the scope of the present invention.

4. Overview

Hereinafter, the above-described embodiment will be collectively described.

For example, a control method of a work machine 1 disclosed herein is a control method of a work machine 1 in which a rotation number of a fan 321 that takes outside air into an engine room 30 accommodating an engine 32 varies with a rotation number N of the engine 32, the control method is configured to include:

executing first control of regenerating a collecting filter unit 68 that collects particulates contained in exhaust gas of the engine 32 by a temperature rise of the exhaust gas;

when the work machine 1 is changed from a steady state to a specific state, executing second control of decreasing an amount of working oil discharged from a hydraulic pump 61 by driving of the engine 32; and, when the first control and the second control are concurrently executed, executing third control of increasing the rotation number N of the engine 32 (first configuration).

The control method of a work machine 1 of the above-described first configuration may be configured such that the specific state includes a state in which a temperature in the engine room 30 is equal to or more than a temperature threshold value higher than a temperature in the steady state (second configuration).

Moreover, the control method of a work machine 1 of the above-described first or second configuration may be configured such that the third control is stopped by an ending of the first control (third control).

Moreover, the control method of a work machine 1 of any one of the above-described first to third configurations may be configured such that, when a target rotation number of the engine 32 is set to be small by a rotation number setting unit 3142 in the third control, executing fourth control of further decreasing the amount of the working oil discharged compared to a setting in the second control while the rotation number N of the engine 32 is kept increased (fourth configuration).

Moreover, the control method of a work machine 1 of the above-described fourth configuration may be configured such that, in the fourth control, a setting of the rotation number setting unit 3142 is set to a low rotation side, and the amount of the working oil discharged is decreased (fifth configuration).

Moreover, the control method of a work machine 1 of any one of the above-described first to fifth configurations may be configured to include, when the target rotation number set by the rotation number setting unit 3142 is set to be lower than a threshold rotation number in the third control, stopping the fourth control; and executing fifth control of controlling the engine 32 on the basis of the target rotation number (sixth configuration).

Moreover, the control method of a work machine 1 of any one of the above-described first to sixth configurations may be configured such that the first control is executed in a state in which the work machine 1 can perform work (seventh configuration).

Moreover, a program disclosed herein is a program for causing a computer to execute a control method of a work machine 1 in which a rotation number of a fan 321 that takes outside air into an engine room 30 accommodating an engine 32 varies with a rotation number N of the engine 32, the program is configured to cause the computer to function as a means for:

executing first control of regenerating a collecting filter unit 68 that collects particulates contained in exhaust gas of the engine 32 by a temperature rise of the exhaust gas;

when the work machine 1 is changed from a steady state to a specific state, executing second control of decreasing an amount of working oil discharged from a hydraulic pump 61 by driving of the engine 32; and, when the first control and the second control are concurrently executed, executing third control of increasing the rotation number N of the engine 32 (eighth configuration).

Moreover, a control system 6 of a work machine 1 disclosed herein includes:

an engine 32 accommodated in an engine room 30;

a fan 321 whose rotation number varies with a rotation number N of the engine 32 and that takes outside air into the engine room 30;

a collecting filter unit 68 that collects particulates contained in exhaust gas of the engine 32;

a hydraulic pump 61 that discharges working oil by driving of the engine 32; and a control unit 69 that controls the engine 32 and a regulator 611, and the control unit 69 is configured to execute first control of regenerating the collecting filter unit 68 by a temperature rise of the exhaust gas, when the work machine 1 is changed from a steady state to a specific state, execute second control of decreasing an amount of the working oil discharged, and, when the first control and the second control are concurrently executed, execute third control of increasing the rotation number N of the engine 32 (ninth configuration).

Moreover, a work machine 1 disclosed herein is configured to include the control system of a work machine 1 of the ninth configuration (tenth configuration).

REFERENCE SIGNS LIST

1 hydraulic excavator
6 control system
30 engine room
32 engine
61 variable capacity pump
63 control valve
64 hydraulic actuator
65 radiator
67 engine ECU
68 DPF
69 integrated ECU
301 temperature sensor
321 fan
612 temperature sensor
651 temperature sensor
681 differential pressure sensor
3142 engine accelerator dial

The invention claimed is:

1. A control method of a work machine in which a rotation number of a fan that takes outside air into an engine room accommodating an engine varies with a rotation number of the engine, comprising:

executing first control of regenerating a collecting filter unit that collects particulates contained in exhaust gas of the engine by a temperature rise of the exhaust gas;

when the work machine is changed from a steady state to a specific state, executing second control of decreasing an amount of working oil discharged from a hydraulic pump by driving of the engine; and, when the first control and the second control are concurrently executed, executing third control of increasing the rotation number of the engine.

2. The control method of a work machine according to claim 1, wherein the specific state includes a state in which a temperature in the engine room is equal to or more than a temperature threshold value higher than a temperature in the steady state.

3. The control method of a work machine according to claim 1, wherein the third control is stopped by an ending of the first control.

4. The control method of a work machine according to claim 1, comprising: when a target rotation number of the engine is set to be small by a rotation number setting unit in the third control, executing fourth control of further decreasing the amount of the working oil discharged compared to a setting in the second control while the rotation number of the engine is kept increased.

5. The control method of a work machine according to claim 4, wherein, in the fourth control, a setting of the rotation number setting unit is set to a low rotation side, and the amount of the working oil discharged is decreased.

6. The control method of a work machine according to claim 4, comprising: when the target rotation number set by the rotation number setting unit is set to be lower than a threshold rotation number in the third control, stopping the fourth control; and executing fifth control of controlling the engine on the basis of the target rotation number.

7. The control method of a work machine according to claim 1, wherein the first control is executed in a state in which the work machine can perform work.

8. A non-transitory computer-readable medium comprising a program stored thereon for causing a computer to execute a control method of a work machine in which a rotation number of a fan that takes outside air into an engine room accommodating an engine varies with a rotation number of the engine, the program causing the computer to function as units for:

executing first control of regenerating a collecting filter unit that collects particulates contained in exhaust gas of the engine by a temperature rise of the exhaust gas;

when the work machine is changed from a steady state to a specific state, executing second control of decreasing an amount of working oil discharged from a hydraulic pump by driving of the engine; and, when the first control and the second control are concurrently executed, executing third control of increasing the rotation number of the engine.

9. A control system of a work machine comprising:

an engine accommodated in an engine room;

a fan whose rotation number varies with a rotation number of the engine and that takes outside air into the engine room;

a collecting filter unit that collects particulates contained in exhaust gas of the engine;

a hydraulic pump that discharges working oil by driving of the engine; and a control unit that controls the engine and a regulator, wherein the control unit executes first control of regenerating the collecting filter unit by a temperature rise of the exhaust gas, when the work machine is changed from a steady state to a specific state, executes second control of decreasing an amount of the working oil discharged, and, when the first control and the second control are concurrently executed, executes third control of increasing the rotation number of the engine.

10. A work machine comprising the control system of a work machine according to claim 9.

* * * * *